United States Patent [19]

Strauss

[11] 4,304,662

[45] Dec. 8, 1981

[54] OPERATING METHOD AND SETTLING MACHINE FOR PROCESSING COAL

[75] Inventor: Werner Strauss, Bochum, Fed. Rep. of Germany

[73] Assignee: Klöckner-Humboldt-Deutz AG, Fed. Rep. of Germany

[21] Appl. No.: 126,990

[22] Filed: Mar. 3, 1980

[30] Foreign Application Priority Data

Mar. 2, 1979 [DE] Fed. Rep. of Germany ..... 2908228

[51] Int. Cl.[3] ..... B03B 5/12

[52] U.S. Cl. ..... 209/457; 209/500

[58] Field of Search ..... 209/455–457, 209/425–427, 500–502

[56] References Cited

U.S. PATENT DOCUMENTS

| | | | |
|---|---|---|---|
| 1,224,138 | 5/1917 | Chance | 209/425 |
| 2,013,414 | 9/1935 | Llewellyn | 209/500 X |
| 2,980,255 | 4/1961 | Aagaard | 209/427 |

FOREIGN PATENT DOCUMENTS

| | | | |
|---|---|---|---|
| 18057 | of 1911 | United Kingdom | 209/427 |

*Primary Examiner*—Ralph J. Hill

*Attorney, Agent, or Firm*—Hill, Van Santen, Steadman, Chiara & Simpson

[57] ABSTRACT

A wet settling machine having a jig screen has the separating liquid mechanically pulsed and the energy of the pulsations is stored in and released from sealed air chambers which open downwardly into the settling liquid.

13 Claims, 3 Drawing Figures

OPERATING METHOD AND SETTLING MACHINE FOR PROCESSING COAL

BACKGROUND OF THE INVENTION

1. Field of the Invention

The present invention relates to a method for processing coal or other minerals, particularly for processing fine granulations, in a wet settling machine having a jig screen on which, preferably, a throughput feldspar bed is arranged and which is periodically pulsed with a separating liquid, and to a settling machine for implementation of the method.

2. Description of the Prior Art

In processing technology it is known to process mineral mixtures, particularly coal, with wet settling machines, whereby a pulsation of a separating liquid is effected by mechanical means such as membranes. Settling machines of this type have the disadvantage that they must be constructed very stable and very heavy in order to be able to withstand the considerable mechanical loads on the movable parts, particularly in the case of great throughput.

SUMMARY OF THE INVENTION

The object of the present invention is to provide an operating method and a settling machine for implementing the operating method which avoids the disadvantages of the known, mechanically operating settling machines and which, in particular, allows normally designed housings as are employed for pneumatically energized settling machines to be employed.

The above object is achieved in that the pulsation of the separating liquid occurs with a mechanical energization and by means of pneumatically stored energy. By storing the energy which is required for the pulsation in or at the settling machine, the mechanical devices for generating the pulsation can advantageously be designed small and light since these, during operation, need only compensate the friction losses of the pulsating fluid and of the moving solids particles. The actual work for each individual stroke is accomplished by the pneumatically stored energy which decelerates the downward motion of the pulsating liquid (water) and initiates the repeat of the upward motion.

In developing the invention, it is provided that the mechanical stimulation proceed sinusoidally. This is particularly advantageous since the wave action of the separating liquid also largely exhibits a sine form. Given a sinusoidal energization, therefore, such a resonance excitation can occur.

In a further development of the invention, it is provided that the mechanical excitation occurs primarily sinusoidally and partially non-sinusoidally. This design is particularly advantageous when the return stroke of the liquid is to be retarded in order to provide the various mineral particles with a longer time for graded settling in layers. For this purpose, the drive must be designed somewhat more rugged; overall, however, an improvement of the separating effect is thereby produced which greatly outweighs the increased expense of the drive.

In a further development of the method, it is provided that the pneumatically energy storage and/or delivery is controlled. By this measure, a deviation of the wave motion from the sine form, as is initiated by a non-sinusoidal excitation, can be advantageously promoted. Also, the addition of a non-sinusoidal excitation and an adapted non-sinusoidal energy storage, is possible to obtain a non-sinusoidal motion which likewise only requires excitation by normal forces. Therefore, the excitation device need not be more strongly designed than in the case for sinusoidal motion.

In order to implement the processing method of the present invention, the wet settling machine has internal pulse energy storage elements, in particular pneumatic pulse energy storage elements, and mechanical excitation elements. Therefore, a wet settling machine for implementing the method of the present invention is advantageously available in which, in particular, the execution of the pulse energy storage elements as pneumatic elements permits a particularly simple and easily controllable storage of the pulse energy within the interior of the settling machine. Therefore, a low-loss storage of the pulse energy can directly occur within the settling machine without employing additional, external storage elements, for example in the form of communicating exterior containers.

In developing the settling machine, it is provided that the pulse energy storage elements are designed as chambers open on the bottom side and, preferably, arranged under the jig screen. This provides a particularly simple structure of the pulse energy storage elements which can be designed, as to their form, like the known excitation air chambers. The pneumatic storage elements release the stored pulse energy in the same manner as the known excitation air chambers release the excitation energy. In comparison to known embodiments of settling machines, the housing of the settling machine can remain unchanged.

It is provided in a further development of the invention that the mechanical excitation elements are arranged under the jig screen and are designed with holes therethrough for the separated fraction to fall through. In this manner it is achieved that the excitation energy is introduced at the most favorable location at which it has a direct influence. Surprisingly, it has proven that the holes for the separated fraction to fall through, which holes are necessary if one works with large-surface excitation elements, result in no deterioration of the excitation effect. Therefore, one can work with large-surface excitation elements which easily initiate the pulsation and function with low losses. The passage of the separated grain fraction toward the bottom for discharge from the settling machine is therefore not inhibited.

It is provided in a further development of the settling machine that the mechanical excitation elements are not arranged parallel, but at an angle to the jig screen, the angle, in particular, being enlarged toward the discharge end of the settling machine. By so doing, it can be achieved that the movement of the processing material to the discharge end of the settling machine is improved and a better discharge is achieved, particularly given low throughputs, i.e. in partial load operation. Therefore, the angle of inclination of the excitation plates is advantageously adjustable in order to allow adaptation to the particular material occupation of the jig screen.

In a further development of the invention it is provided that the pneumatic pulse energy storage elements have intake and/or discharge control devices and that the motion of the mechanical excitation elements is generated by means of adjustable cranks or thrust slip devices. It is advantageously achieved by both of these features that the pulsations, despite the utilization of mechanical excitation elements, can be controlled both in terms of form and magnitude. The primary energy which generates the wave motion is controlled, for example the back stroke is retarded, by the intake and/or discharge control devices of the pneumatic pulse energy storage elements. The amplitude and frequency of the pulsation is adjusted by adjusting the amplitude and frequency of the excitation.

The design of the intake and/or discharge control devices is very simple, particularly in pneumatic energy storage, since such simple valve flaps which, for example, retard the readmission of air into the storage chamber, can be employed.

BRIEF DESCRIPTION OF THE DRAWING

Other objects, features and advantages of the invention, its organization, construction and mode of operation will be best understood from the following detailed description, taken in conjunction with the accompanying drawing, on which.

DESCRIPTION OF THE PREFERRED EMBODIMENTS

Figure 1:
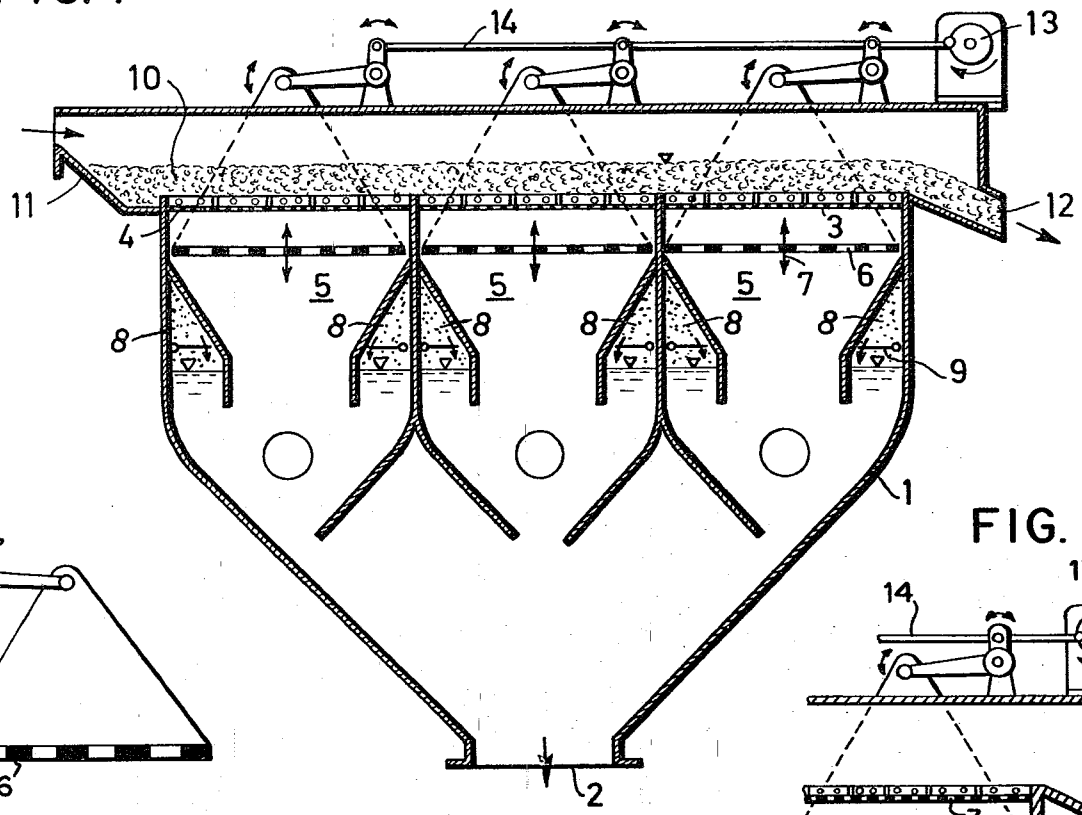
FIG. 1 is a longitudinal section of a settling machine constructed in accordance with and operating with the present invention.

Referring to the drawing, a settling tank 1 has a material discharge 2 under which a bucket conveyor (not illustrated) is provided. The settling machine also comprises a feldspar bed 3 over which the material passes for separation. The feldspar bed 3 extends over a perforate sifter 4 which terminates the individual separation chambers 5 at the top thereof.

Mechanical excitation elements 6, whose up and down motion is indicated by the arrows 7, are located in the separating liquid chambers 5. The energy storage chambers 8, which are preferably arranged in pairs are located within the chambers 5, the energy storage chambers 8, as needed, being provided with valve flaps 9 if pulse motions deviating from a sine wave are to be achieved. The energy storage chambers 8 are filled with air which rhythmically compresses and expands during the up and down motions of the separating liquid, storing and releasing the pulsation energy. The layer of material to be processed is located over the feldspar bed 3, in which layer the material particles migrate from a point of entry 11 to a discharge 12.

Figure 2:
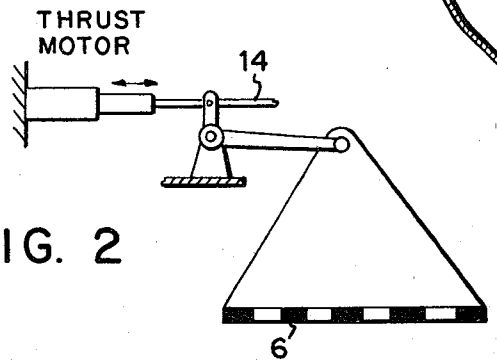
FIG. 2 is a schematic illustration of a thrust crank drive to replace the eccentric drive of FIG. 1.

The excitation elements are preferably constructed as rectangular plates 6 and occupy nearly the entire cross section of the chambers 5. The excitation elements are caused to oscillate by an eccentric drive 13 whereby a transmission rod 14 illustrated on the drawing shows only one of many possible embodiments. If a non-sinusoidal motion of the excitation elements 6 is desired, the eccentric drive 13 can be replaced, for example, by a thrust crank drive (FIG. 2). For example, this permits a quick upward and a slow downward motion of the excitation elements 6 to be achieved. For adapting the characteristics of the return motion of the expanded air into the energy storage chambers 8 to the downward motion, the energy storage chambers 8 are preferably provided with appropriate choke valves 9.

Figure 3:
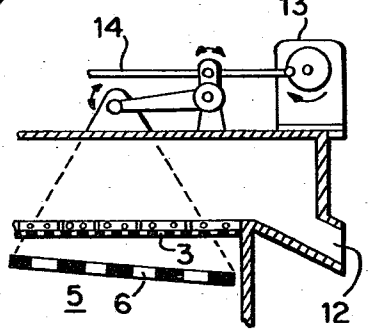
FIG. 3 is a fragmentary sectional view of the discharge end of the apparatus of FIG. 1 illustrating an angular disposition for the perforate excitation plate.

FIG. 3 illustrates one of the rectangular plates disposed at an angle with respect to the jig screen. The angle of each of the plates increases toward the discharge end 12 of the settling machine.

The settling machine and operating method of the present invention are particularly suited for processing fine-grained coal. However, without departing from the framework of the invention, the settling machine and its operating method can likewise be employed in processing other minerals, such as iron ore, non-ferrous ore, and the like.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a method of operating a wet settling machine for separating mineral mixtures, in particular fine granulations, in which the mixture moves from an entry to a discharge over at least one separating chamber on a perforate jig structure and is subjected to the separating action of a pulsating separating liquid, the improvement therein comprising the steps of:

mechanically energizing the separating liquid into pulsation; and pneumatically storing and releasing the energy of the pulsating separating liquid.

2. The method of claim 1, wherein the step of mechanically energizing the separating liquid is further defined as:

mechanically energizing the separating liquid sinusoidally.

3. The method of claim 1, wherein the step of mechanically energizing the separating liquid is further defined as:

mechanically energizing the separating liquid partially sinusoidally and partially non-sinusoidally.

4. The method of claim 1, wherein the step of storing and releasing energy is further defined as:

controlling the rate of at least one of pneumatically storing and releasing the energy.

5. In a wet settling machine of the type in which a mineral mixture to be separated is moved from an entry to a discharge on a perforate jig structure over a separating chamber and is subjected to the separating action of a pulsating separating liquid, the improvement therein comprising:

mechanical means, including an excitation element in the settling chamber, operable to mechanically energize the settling liquid into pulsation; and pneumatic energy storage means in the separating chamber for storing and releasing the energy of the pulsating liquid.

6. The machine of claim 5, wherein said pneumatic energy storage means comprises:

at least one pneumatic energy storage element in the separating chamber.

7. The machine of claim 5, wherein said pneumatic energy storage means comprises:

at least one air-filled chamber in the separating chamber including closed top and sides and a structurally open bottom which is closed by the separating liquid.

8. The machine of claim 7, and further comprising:

energy rate control means in said air-filled chamber.

9. The machine of claim 8, wherein said energy rate control means comprises:

valve means.

10. The machine of claim 5, wherein said excitation element comprises:

a perforate plate for permitting separated material to fall through.

11. The machine of claim 10, wherein said perforate plate is disposed at an angle to the jig structure, which angle is enlarged toward the discharge.

12. The machine of claim 5, wherein said mechanical means comprises:

an adjustable crank drive connected to said excitation element.

13. The machine of claim 5, wherein said mechanical means comprises:

a thrust drive connected to said excitation element.

* * * * *